United States Patent [19]

Millay et al.

[11] Patent Number: 4,513,541

[45] Date of Patent: Apr. 30, 1985

[54] MACHINE WORKHEAD WITH MAGNETIC DRIVER

[75] Inventors: Lawrence I. Millay; Victor F. Dzewaltowski, both of Springfield, Vt.

[73] Assignee: Ex-Cell-O Corporation, Troy, Mich.

[21] Appl. No.: 444,131

[22] Filed: Nov. 23, 1982

[51] Int. Cl.[3] ..... B24B 5/02

[52] U.S. Cl. ..... 51/237 R; 279/1M

[58] Field of Search ..... 51/236, 237 R, 290, 51/291; 279/1 M

[56] References Cited

U.S. PATENT DOCUMENTS

| | | | |
|---|---|---|---|
| 2,812,185 | 11/1957 | Snell | 279/1 M |
| 3,273,292 | 9/1966 | Seidel | 51/237 R |
| 3,604,161 | 9/1971 | Zvezdnaya et al. | 51/237 R |
| 3,750,343 | 8/1973 | Johnson | 51/237 R |
| 3,893,676 | 7/1975 | Gloshinski et al. | 51/237 R |

*Primary Examiner*—Harold D. Whitehead

*Attorney, Agent, or Firm*—Edward J. Timmer

[57] ABSTRACT

An electromagnet is disposed between a pair of bearings rotatably mounting a spindle in the housing of a machine workhead, such as the workhead of a grinding machine. The magnetic flux from the electromagnet is guided by the spindle extending therethrough to its workpart driving end located outside the housing. Bearing shoes engaging the workpart are connected to the housing so as to complete the magnetic flux path to the electromagnet through the housing. Non-magnetic shields are disposed between the bearings and the electromagnet and housing to prevent wear debris accumulation and etching of the bearing components from magnetic flux effects.

7 Claims, 1 Drawing Figure

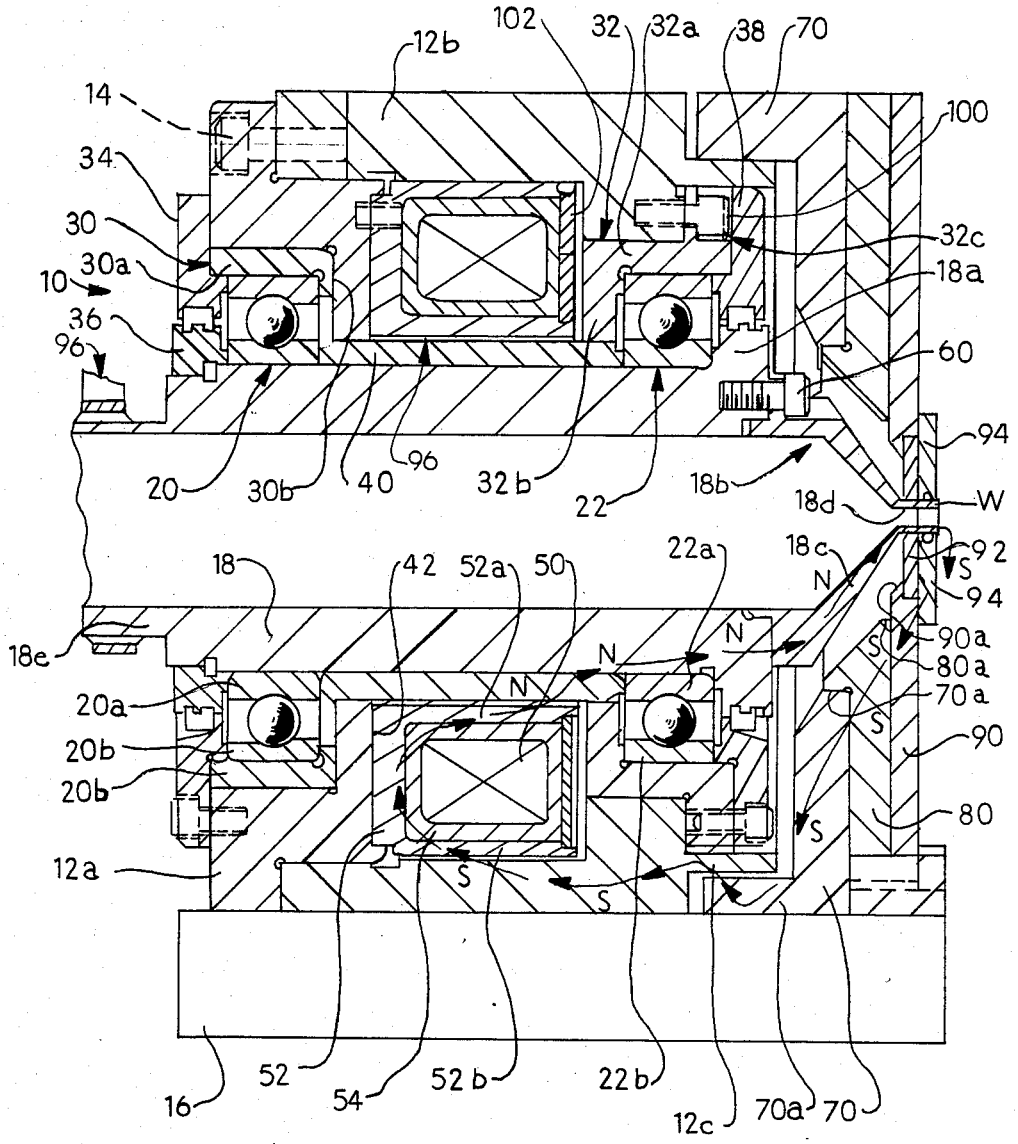
102
32
32a
38
70
12b
14
100
34
30
32c
30a
18a
10
36
60
96
94
20
30b
40
96
32b
22
18b
18d
W
92
18c
22a
S
N
94
18
42
52a
50
90a
18e
80a
70a
20a
90
20b
80
12a
16
52
54
52b
22b
12c
70a
70

MACHINE WORKHEAD WITH MAGNETIC DRIVER

FIELD OF THE INVENTION

The invention relates to machine tools and, in particular, to a machine workhead with a magnetic workpart driver.

BACKGROUND OF THE INVENTION

The Snell U.S. Pat. No. 2,812,185 issued Nov. 5, 1957 describes a centerless grinding machine having a magnetic driver for holding the workpart during grinding. The machine includes a rotatable spindle mounted in a housing by anti-friction bearings and having a cantilevered end extending outside the housing. Mounted on the cantilevered end outboard of the anti-friction bearings is the magnetic driver assembly engaging the workpart. The assembly includes inter-fitting face pieces provided with a magnetic flux by an annular magnet and pair of pole pieces inside the assembly. The magnet and pole pieces are axially movable inside the assembly to divert flux from the workpart to facilitate its removal after grinding.

More recently, grinding machines have employed an electro-magnetic driver in which an annular electromagnet coil is mounted to the stationary machine housing around the cantilevered end of the rotatable spindle. The driver that engages the workpart is attached to the spindle end and rotatable therewith. As in the grinding machine described in the aforementioned Snell U.S. Pat. No. 2,812,185, the coil and driver are located outboard from the spindle anti-friction bearings outside the machine housing.

The grinding machines described having the magnet or electro-magnet coil disposed outboard from the spindle bearings outside the machine housing suffer from several disadvantages. In particular, the magnet or electromagnet and any associated couplings are interposed between the spindle bearings and workpart driver. This increases the distance between the workpart driver and bearings and thus accentuates undesirable movement of the workpart driver due to any imperfections in the spindle bearings and their alignment. Of course, this further translates into undesirable movement of the workpart during the grinding operation. Also, the size and cost of the grinding machine are increased as a result of interposing the magnet or electro-magnet between the spindle bearings and workpart driver.

SUMMARY OF THE INVENTION

An object of the invention is to provide a machine workhead, especially a grinding machine workhead, with a magnetic workpart driver which overcomes the aforementioned disadvantages of the prior art.

Another object of the invention is to provide such a machine workhead wherein a magnet means is disposed between a pair of antifriction bearings rotatably supporting a spindle inside a stationary machine housing and wherein a means is provided to create a magnetic flux path between the workpart driver located outside the housing on the end of the spindle and the magnet means inside the housing.

Still another object of the invention is to provide such a machine workhead wherein non-magnetic shield means are provided to keep magnetic flux out of the antifriction bearings to avoid attracting wear debris therein and generating electric currents which could etch the bearing components.

Still another object of the invention is to provide such a machine workhead wherein the shield means does not adversely affect the magnetic flux path to the workpart driver outside the machine housing.

In a typical working embodiment of the present invention, the machine workhead includes a housing means, a spindle means rotatably supported in the housing means by bearing means spaced apart along the length of the spindle means and means for rotating the spindle means. Importantly, magnet means is disposed in the space between the bearing means preferably coaxial therewith with the spindle means extending therethrough. The magnet means generates a magnetic flux guided by the spindle means to its driving end or face located outside the housing means and adapted to engage the workpart. Flux guide means is provided to complete the magnetic flux loop from the workpart to the magnetic means through the housing means so that the workpart is held on the driving face of the spindle means by magnetic flux forces. Preferably, shield means are positioned between the bearing means and magnet and housing means to magnetically isolate the bearing means to avoid shunting of the magnetic flux and also to avoid attraction and accumulation of wear debris therein and generation of electric currents in the bearing means which would etch bearing components, such as balls and races.

In a preferred embodiment of the invention, the magnet means comprises an electromagnet coil positioned between a pair of anti-friction bearings coaxial therewith and through which the spindle extends.

In another preferred embodiment, the flux guide means comprises one or more bearing shoes contacting the workpart to properly position the exterior or outer diameter of the workpart during centerless grinding, the shoes being supported by one or more support members in contact with the machine housing to complete the flux path from the workpart to the magnet means.

In still another preferred embodiment, the shield means comprises a non-magnetic shield member having an axial sleeve portion separating the associated anti-friction bearing from the machine housing and having a radial flange portion separating the associated anti-friction bearing from the electro-magnet coil.

BRIEF DESCRIPTION OF THE DRAWING

The FIGURE is a sectional view taken longitudinally through the workhead of the grinding machine.

DESCRIPTION OF THE PREFERRED EMBODIMENTS

The FIGURE illustrates a workhead 10 constructed in accordance with the invention for use on a known centerless grinding machine, such as a Model B Centalign® internal grinding machine manufactured by Bryant Grinder Corporation, Springfield, Vt. The workhead 10 is used with other components such as grinding wheel, wheel feed mechanism, dresser. etc., employed on such grinding machines. Of course, the present invention is not limited to this particular type of grinding machine or, for that matter, to any type of machine tool wherein a workpart is rotated during machine operation.

The workhead 10 is illustrated as having a housing 12 comprising a first housing section **12*a* and second housing section 12*b* bolted together as by bolts 14 (only one of which is shown). The housing 12 is supported on a plate 16 on the machine bed (not shown). A hollow spindle 18 is shown rotatably supported in the housing 12 by first and second anti-friction bearings 20 and 22. Typically, a gage head or transducer (not shown) is slidably mounted in the hollow spindle to monitor grinding of the workpart inner diameter. As will be explained in more detail herebelow, the anti-friction bearings 20 and 22 are supported in the housing by non-magnetic shield members 30 and 32, respectively. Threaded locking collars 34 and 36 retain the outer race 20***a* and inner race 20*b*, respectively, of bearing 20. Similarly, collar 38 and radial flange 18*a* of the spindle retain the outer race 22*a* and inner race 22*b*, respectively, of bearing 22. A tubular separator member 40 is disposed between the inner races 20*a*, 22*a* on spindle 18 as shown and is made of magnetically permeable material such as low carbon steel.

It is apparent that the housing sections 12*a* and 12*b* define an annular chamber 42 between bearings 20 and 22. Disposed in this chamber is an electromagnet means comprising a coil 50, hollow U-shaped iron or other magnetically permeable annulus member 52 separated by insulation layer 54. Of course, the coil 50 is connected to a suitable electrical D.C. power source (not shown) as is well known.

The spindle 18 includes a driving end 18*b* bolted thereto as by bolts 60 (only one of which is shown). The driving end includes the frusto-conical portion 18*c* which terminates in a hollow cylindrical portion 18*d* having an annular end face against which the hollow workpart W is engaged and driven during grinding by magnetic flux forces as will be described. The frusto-conical portion decreases in cross-section toward the cylindrical portion to concentrate the magnetic flux for workpart driving purposes.

Supported on plate 16, as shown, is a tooling support plate 70. The support plate 70 includes an axial annular flange 70*a* which is adapted to slide over and mate with a complementary annular flange 12*c* on housing section 12*b*. Of course, the support plate 70 has a central opening 70*b* through which the driving end 18 *b* of the spindle extends outside the housing section 12*b*. The support plate 70 supports a first adapter plate 80 and second adapter plate 90 which are held together by suitable means such as bolts or screws. Both plates 80 and 90 include central openings 80*a* and 90*a* through which the spindle driving end 18*b* extends as shown. The loader plate 90 also includes a non-magnetic shield menber 92 having a central opening allowing cylinder portion 18*d* to extend therethrough in close fit. Bearing shoes 94 are also supported on plate 90 to engage the outer diameter of the workpart W during grinding to properly position the workpart as is well known. The support plate 70 and adapter plates 80, 90 and shoes 94 may be part of a workpart loader/unloader mechanism attached to or supported adjacent the workhead and spindle driving end 18*b*. As used herein, "workhead" is intended to include the workhead alone or with such loader/unloader mechanisms or other accessories.

Of course, suitable means such as an electric motor or the like (not shown) coupled to a drive belt 96 rotate the end 18*e* of spindle 18 during grinding while the workpart W is engaged against the end face of cylindrical portion 18*d* by magnetic flux forces as described below.

During operation, the coil 50 is energized such that the iron annulus 52 becomes a magnet with polarity as shown wherein "N" indicates north and "S" indicates south. It is apparent the inner sleeve 52*a* of the iron annulus assumes the N condition as does the separator 40, spindle 18 and spindle driving end 18*b*. The outer sleeve 52*b* of the iron annulus assumes the S condition as does the housing section 12*b*, support plate 70, adapter plate 80, loader plate 90 and bearing shoes 94. As a result, a magnetic flux is caused to traverse through the workhead as generally indicated by arrows and thereby hold the workpart against the end face of the spindle driving end 18*b* while the spindle is rotated. In particular, the spindle 18 and its driving end 18*b* provide a partial flux guide path between the electromagnet means and the workpart W. The bearing shoes 94, plates 70, 80 90 and housing section 12*b* complete the magnetic flux path between the workpart and electromagnet means as shown by the arrows.

It will be apparent that the flux must jump the slight space 96 between the inner sleeve 52*a* of the iron annulus and the separator 40. This space 96 is of course maintained sufficiently small that the flux is not significantly diminished by this jumping. Likewise, the flux may jump the slight space between the flange 12*c* of housing section 12*b* and flange 70*a* of support plate 70 and/or it may traverse from support plate 70 through plate 16 and then to housing section 12*b*.

To protect the anti-friction bearings 20 and 22 from attraction and accumulation of wear debris therein and electric currents resulting from the magnetic flux effects, non-magnetic shield members 30 and 32 are provided adjacent bearings 20 and 22, respectively. The shields also prevent undesirable shunting of the magnetic flux through the bearings. Each shield member includes an axial sleeve portion 30*a*, 32*a* between the bearing and respective housing section 12*a*, 12*b* and a radial flange 30*b*, 32*b* between the bearing and coil/iron annulus 50/52. The shield 30 is held in place by collar 34 whereas shield 32 includes a second radial flange 32*c* bolted to housing section 12*b* by bolts 100 (only one of which is shown). Collar 38 retains outer race 22*b* of bearing 22 in shield 32 as shown. Typically, the shield members 30, 32 are made of non magnetic stainless steel. Annular, non-magnetic shield 102 closes off the U-shaped annulus 52 adjacent bearing 22 to provide further shielding action.

To prevent shunting of magnetic flux between the spindle driving end 18*b* (in particular, cylindrical portion 18*d*) and the bearing shoes 94, the annular shield member 92 is interposed therebetween in known fashion.

Those skilled in the art will appreciate that the magnetic flux path from the workpart back to the coil 50 may be provided by using a flux guide member (not shown) in lieu of the support plate 70, first adapter plate 80, second adapter plate 90 and shoes 94 of a loader/unloader mechanism. The flux guide member would function in the same manner to provide a magnetic flux path from the workpart to the coil 50 through the housing section 12*b*.

Those skilled in the art will recognize that while the invention has been described by a detailed description of certain specific and preferred embodiments, various modifications and changes can be made in them within the scope of the appended claims which are intended to also include equivalents of such embodiments.

We claim:

1. A machine workhead for rotating a workpart, comprising a stationary housing means, a spindle means rotatably mounted in the housing means for rotation about a longitudinal axis by multiple bearing means spaced apart exteriorily along the length of the spindle means between said spindle means and housing means and having a driving end outside the housing means for engaging a workpart, a magnet means disposed in the housing means radially and longitudinally in the space between the bearing means in closely spaced radial juxtaposition to the spindle means with the spindle means extending therethrough such that when said magnet means generates magnetic flux said flux is guided by the spindle means and its driving end to traverse between said magnet means and workpart along a flux path from between the bearing means through the spindle means interiorily of one of said bearing means, means for completing the magnetic flux path between the workpart and magnet means along a flux path through the housing means exteriorily of said one of said bearing means and returning to between the bearing means, and means for rotating the spindle means with the workpart held on the driving end by magnetic flux forces.

2. The machine workhead of claim 1 wherein the machine further includes non-magnetic shield means disposed between the magnet means and bearing means to magnetically isolate the bearing means.

3. The machine workhead of claim 1 wherein the magnetic flux path means comprises a means engaging the workpart when it is on the driving end, said means being connected to the housing means such that magnetic flux can flow therebetween.

4. A grinding machine workhead for rotating a workpart, comprising a stationary housing means, a spindle means rotatably mounted in the housing means for, rotation about a longitudinal axis by a pair of anti-friction bearing means spaced apart exteriorily along the length of the spindle means between said spindle means and housing means and having a driving end outside the housing means for engaging the workpart, an electromagnet means disposed in the housing means radially nd longitudinally in the space between the bearing means coaxial therewith in closely spaced radial juxtaposition to the spindle means with th spindle means extending axially therethrough such that when said electromagnet means generating generates magnetic flux said flux is guided by the spindle means and its driving end to traverse between the electromagnet means and the workpart along a flux path from between the bearing means through the spindle means interiorily of one of said bearing means nearest to the driving end of the spindle means, show means engaging the workpart during grinding and connected to the housing means so as to complete the magnetic flux path between the workpart and the electromagnet means along a flux path through the housing means exteriorily of said one of said bearing means and returning to between the bearing means, non-magnetic shield means disposed between said one of said bearing means and said electromagnet means for diverting magnetic flux therefrom and means for rotating the spindle means with the workpart held on the driving end by magnetic flux forces.

5. The machine workhead of claim 4 which further includes a pair of non-magnetic shield means each having an axial sleeve portion extending between the respective bearing means and housing means and having a radial flange portion extending between the respective bearing means and electromagnet means.

6. Thre machine workhead of claim 4 wherein the electromagnet means comprises a magnetically permeable hollow annulus disposed radially and longitudinally in the space between the bearing means in closely spaced radial juxtaposition to the spindle means through which the spindle means extends, and a coil disposed in the annulus and connected to an electrical power source.

7. The machine workhead of claim 4 wherein the driving end of the spindle means comprises a single frusto-conical portion with a hollow cylindrical end portion having an annular end face for engaging the workpart, the frusto-conical portion decreasing in cross-section toward the cylindrical portion to concentrate magnetic flux at the cylindrical portion and end face.

* * * * *